US009968516B2

(12) United States Patent
Rogers et al.

(10) Patent No.: US 9,968,516 B2
(45) Date of Patent: May 15, 2018

(54) CLOSURE WITH SEQUENCED DOUBLE RELEASE

(71) Applicant: Creative Mechanisms, Inc., Langhorne, PA (US)

(72) Inventors: Anthony R. Rogers, Langhorne, PA (US); Shuichi Amano, Bethlehem, PA (US)

(73) Assignee: Creative Mechanisms, Inc., Langhorne, PA (US)

( * ) Notice: Subject to any disclaimer, the term of this patent is extended or adjusted under 35 U.S.C. 154(b) by 182 days.

(21) Appl. No.: 14/934,120

(22) Filed: Nov. 5, 2015

(65) Prior Publication Data

US 2016/0130049 A1 May 12, 2016

Related U.S. Application Data

(60) Provisional application No. 62/076,467, filed on Nov. 6, 2014.

(51) Int. Cl.

| | |
|---|---|
| ***A61J 1/03*** | (2006.01) |
| ***B65D 47/08*** | (2006.01) |
| ***B65D 50/06*** | (2006.01) |

(52) U.S. Cl.

CPC ..... *A61J 1/03* (2013.01); *B65D 47/0842* (2013.01); *B65D 50/066* (2013.01); *B65D 2215/04* (2013.01)

(58) Field of Classification Search

CPC .. B65D 50/066; B65D 47/0857; B65D 55/02; B65D 43/16; B65D 2215/04

USPC ..... 215/201, 254.3, 239, 211, 295, 237; 220/254.3, 263, 243

See application file for complete search history.

(56) References Cited

U.S. PATENT DOCUMENTS

| | | | | |
|---|---|---|---|---|
| 4,170,315 | A * | 10/1979 | Dubach | B65D 47/0814 220/281 |
| 5,746,338 | A * | 5/1998 | Takahashi | B65D 43/26 215/237 |
| 5,908,125 | A * | 6/1999 | Opresco | B65D 50/046 215/216 |
| 6,431,380 | B1 | 8/2002 | Branson | |
| 8,292,110 | B2 * | 10/2012 | Rutter | B65D 47/0838 215/201 |

* cited by examiner

*Primary Examiner* — Anthony Stashick
*Assistant Examiner* — Raven Collins
(74) *Attorney, Agent, or Firm* — LaMorte & Associates, P.C.

(57) ABSTRACT

A child-resistant closure for a container. The closure has a first groove and a second groove formed into a base. A cap covers an opening in the base. The cap can rotate between a closed position, a primed position and an open position. The cap has a nub that engages the first groove on the base, when in its closed position, engages the second groove on the base when in its primed position, and is free of any groove when in its open position. A mechanical activator is coupled to the base with a teeter connection. The mechanical activator displaces the cap from the closed position to the primed position when a first section of the mechanical activator is depressed. The mechanical activator displaces the cap from the primed position to the open position when a second section of the mechanical activator is depressed.

16 Claims, 7 Drawing Sheets

CLOSURE WITH SEQUENCED DOUBLE RELEASE

RELATED APPLICATION

This application claims the benefit of U.S. Provisional Patent Application No. 62/076,467, filed Nov. 6, 2014.

BACKGROUND OF THE INVENTION

1. Field of the Invention

In general, the present invention relates to child-safe closures for use on pill bottles and other such containers. More particularly, the present invention relates to child-safe closures with contact areas that must be manually depressed in a predetermined sequence in order to open the child-safe closure.

2. Prior Art Description

The Poison Prevention Packaging Act of 1970 requires that manufacturers of prescription drugs, over-the-counter (OTC) drugs, household chemicals, and other hazardous materials package those products in packaging that inhibits young children from opening the packaging. The specialized packaging is often referred to as "child-resistant packaging" in the industry. Child-resistant packaging can take many forms. However, if the product being sold is in pill form, the most commonly used child-resistant packaging is a pill container with a child-resistant closure.

Child-resistant closures are specialized closures that attach to the neck of the containers. The child-resistant closure can only be opened if the child-resistant closure is manipulated in a specific way. For example, many manufacturers use child-resistant closures that must be aligned in a specific direction in order to open or must be squeezed in certain places in order to open. Such closures are exemplified by U.S. Pat. No. 6,431,380 to Branson, entitled Child Resistant Flip Top Closure.

Such complex manipulations do work to prevent small children from accidentally opening a pill container. However, the need to perform such complex manipulations has the unwanted side effect of also making it difficult for the elderly, handicapped and infirm to open pill containers. Such users often lack the hand strength or dexterity to preform the needed closure manipulations. Furthermore, many such prior art child resistant closures require a person to use two hands to open the closure. Many people, due to stroke, amputation, and/or injury do not have full use of both hands. As such, these people must seek assistance in order to open many of their medications.

It will therefore be understood that a need exists for a new closure design that is both difficult enough to open to be considered child-resistant, yet easy enough to be opened quickly using only one hand. In the prior art, this balance has been difficult to achieve and has often resulted in complex closure designs that are expensive to manufacture. The need, therefore, also requires that the child-resistant closure be both simple and inexpensive to manufacture. These needs are met by the present invention as described and claimed below.

SUMMARY OF THE INVENTION

The present invention is a child-resistant closure for a container. The closure has a base that attaches to the container. The base defines an opening. The base also has a first groove and a second groove formed into the base at different elevations.

A cap is provided for selectively covering the opening in the base. The cap is joined to said base at a hinged connection, wherein the cap can rotate about the hinge connection between a closed position, a primed position and an open position. The cap has a nub thereon that engages the first groove on the base, when in its closed position, engages the second groove on the base when in its primed position, and is free of any groove when in its open position.

A mechanical activator is coupled to the base with a teeter connection. The mechanical activator has a first section and a second section on opposite sides of the teeter connection that teeter about the teeter connection. The mechanical activator displaces the cap from the closed position to the primed position when the first section of the mechanical activator is depressed. Furthermore, the mechanical activator displaces the cap from the primed position to the open position when the second section of the mechanical activator is depressed.

Since the mechanical activator can only move the cap to the open position from the primed position, it will be understood that the mechanical activator must be engaged in a specific sequence. The first section of the mechanical activator must be depressed in order to move the cap from its closed position to its primed position. The second section of the mechanical activator must then be depressed to open the cap. This sequenced opening inhibits children, yet can be performed with one hand by an adult.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention child-resistant closure can be embodied in many ways to fit a wide array of containers, only two exemplary embodiments are shown. The exemplary embodiments have been selected for the purposes of illustration and discussion since they represent two of the best modes contemplated for the invention. The illustrated embodiments, however, are merely exemplary and should not be considered a limitation when interpreting the scope of the appended claims.

Figure 1:
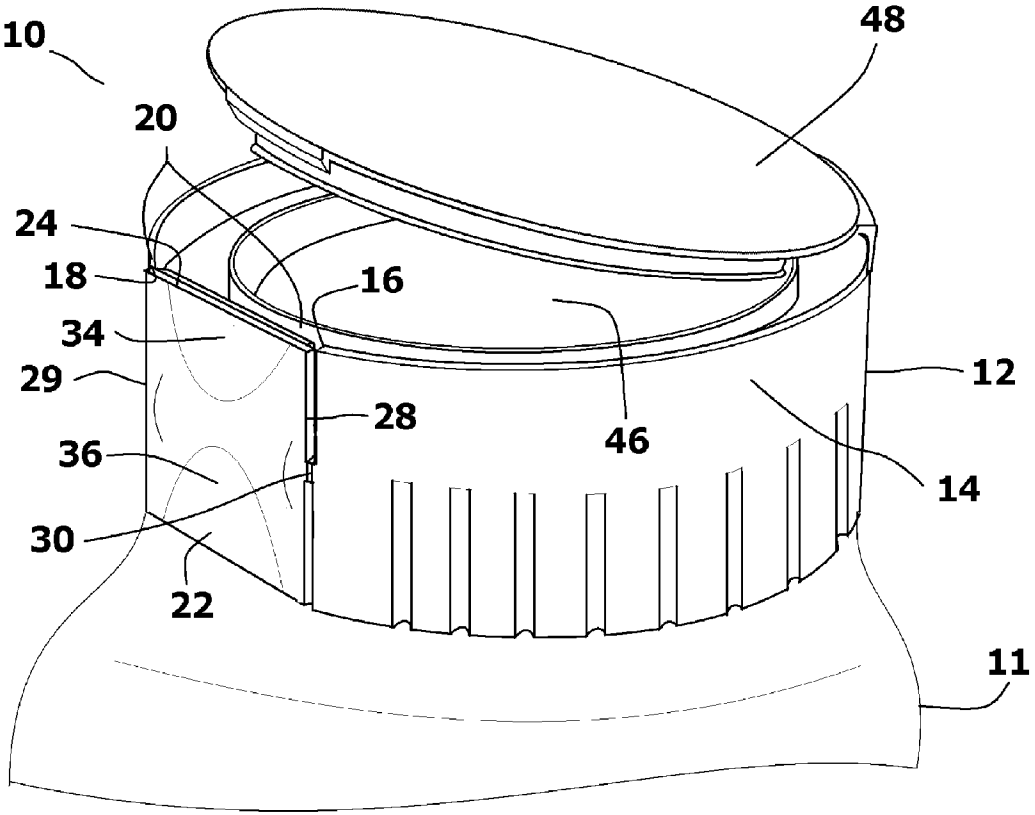
FIG. 1 is a perspective view of an exemplary embodiment of a closure.
Figure 2:
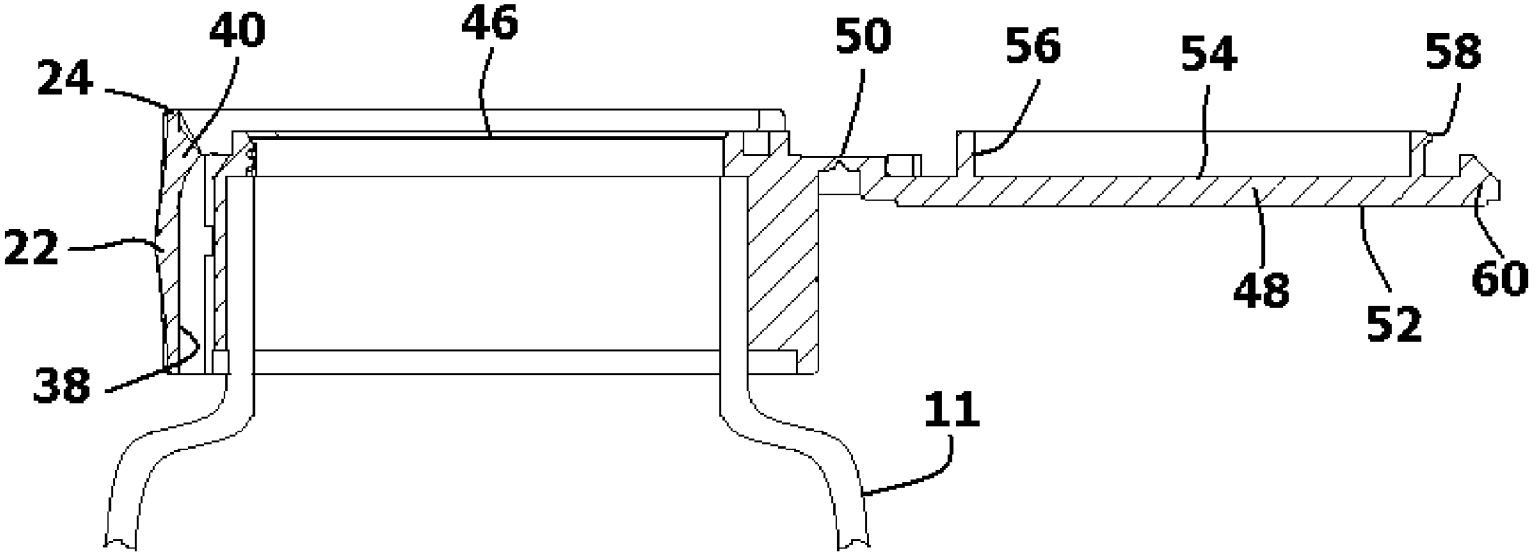
FIG. 2 is a cross-sectional view of the closure of FIG. 1 shown in an open position.

Referring to FIG. 1 in conjunction with FIG. 2, a child-resistant closure assembly 10 is shown. The closure assembly 10 is used to close a container 11, such as a pill container, that is required to have some child safety feature that inhibits access to the contents of the container 11.

The closure assembly 10 mounts to the neck of the container 11 in a traditional manner. The closure assembly 10 has an annular base 12 that engages the neck of a container 11. The annular base 12 has a peripheral wall 14 that extends between 310 degrees to 340 degrees around the annular base 12. In the shown embodiment, the peripheral wall 14 extends approximately 320 degrees around the periphery of the annular base 12, from a first end 16 to a second end 18. This leaves an arcuate gap 20 in the peripheral wall 14 between the first end 16 and the second end 18.

An activation plate 22 is provided. The activation plate 22 has an exterior surface 23. The activation plate 22 is sized to fit into the arcuate gap 20 between the first end 16 and the second end 18 of the peripheral wall 14. The activation plate 22 is rigid and has a top edge 24, a bottom edge 26 and two parallel side edges 28, 29. The activation plate 22 attaches to the annular base 12 using two horizontally aligned pivot connections 30. The pivot connections 30 are disposed generally halfway between the top edge 24 and the bottom edge 26 of the activation plate 22. This enables the top edge 24 and the bottom edge 26 of the activation plate 22 to teeter about the horizontally aligned pivot connections 30.

In the shown embodiment, the activation plate 22 has an upper section 34 and a lower section 36. The upper section 34 extends between the top edge 24 of the activation plate 22 and the imaginary horizontal line between the pivot connections 30. The lower section 36 extends between the bottom edge 26 of the activation plate 22 and the pivot connections 30. The pivot connections 30 act as a fulcrum between the upper section 34 and the lower section 36. Consequently, either the upper section 34 or the lower section 36 of the activation plate 22 can be pressed inwardly. It will therefore be understood that when the activation plate 22 is pressed near its bottom edge 26, the lower section 36 moves toward the center of the annular base 12 and the top edge 24 teeters away from the annular base 12. Likewise, when the activation plate 22 is pressed near its top edge 24, the top edge 24 moves toward the center of the annular base 12 and the bottom edge 26 teeters away from the annular base 12. Since the activation plate 22 teeters about the pivot connections 30, only one of the sections 34, 36 can be depressed at any one moment.

Figure 4:
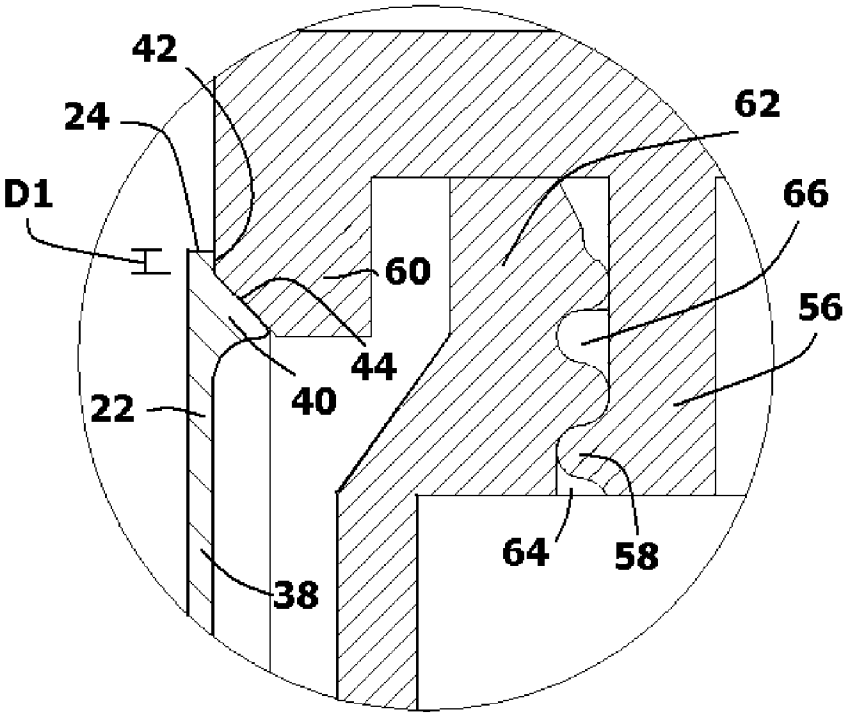
FIG. 4 is an enlarged view of the section of FIG. 3 shown in circled area 4.
Figure 3:
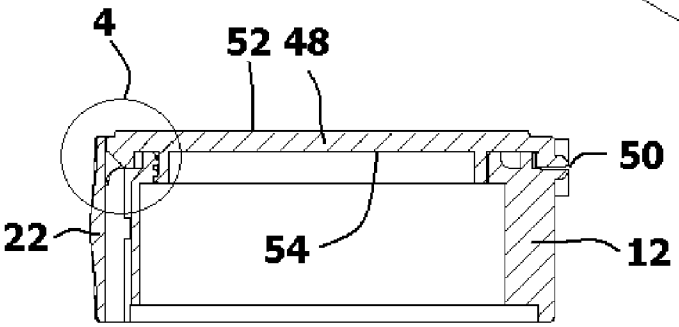
FIG. 3 is a cross-sectional view of the closure of FIG. 1 shown in a fully closed position.

Referring to FIG. 3 and FIG. 4 in conjunction with FIG. 1 and FIG. 2, it can be seen that the activation plate 22 has an inside surface 38 that faces toward the center of the annular base 12. A protrusion 40 extends inwardly from the inside surface 38 near the top edge 24. The protrusion 40 is positioned a short distance D1 from the top edge 24. As such, a first flat section 42 extends from the top edge 24 to the protrusion 40. At the bottom of the flat section 42, the inside surface 38 transitions into a sloped section 44. Both the flat section 42 and the sloped section 44 serve a purpose that is later explained.

The annular base 12 has a top opening 46. Pills or other material from the container 11 must pass through the top opening 46 to exit the container 11. The top opening 46 of the annular base 12 can be selectively covered by a flip cap 48. The flip cap 48 is attached to the annular base 12 at a hinge joint 50. The flip cap 48 can rotate about the hinge joint 50 into three distinct positions. Those positions include a fully open position, a fully closed position, and a primed position. As will be explained, in the fully closed position and the primed position, the flip cap 48 seals the top opening 46 of the annular base 12 and prevents access to the contents of the container 11. In the fully open position, the flip top 48 does not fully obstruct the top opening 46 of the annular base 12 and the contents of the container 11 can be accessed.

The flip cap 48 has a top surface 52 and a bottom surface 54. A circular wall 56 extends downwardly from the bottom surface 54 of the flip cap 48 at a perpendicular to the bottom surface 54. The diameter of the circular wall 56 is only slightly smaller than the diameter of the top opening 46 of the annular base 12. This enables the circular wall 56 to pass into the top opening 46 when the flip cap 48 is in its fully closed position or primed position.

A nub 58 is formed on the circular wall 56 along the area of the circular wall 56 that faces the gap 20 in the peripheral wall 14 of the annular base 12. Furthermore, a lifting wedge 60 extends from the bottom surface 54 of the flip cap 48 along the periphery of the flip cap 48. The lifting wedge 60 extends in an arc only in the area of the flip cap 48 that closes over the gap 20 in the peripheral wall 14 of the annular base 12. The nub 58 and the lifting wedge 60 are used as part of a lock mechanism that is operated by the manipulations of the activation plate 22.

Referring to FIG. 3 in conjunction with FIG. 4, it can be seen that the annular base 12 includes a locking ring 62 that defines the periphery of the top opening 46. In the area of the locking ring 62 that spans across the gap 20, the locking ring 62 is configured with a first groove 64 and a higher second groove 66, wherein the first groove 64 and the second groove 66 are in parallel planes.

Figure 5:
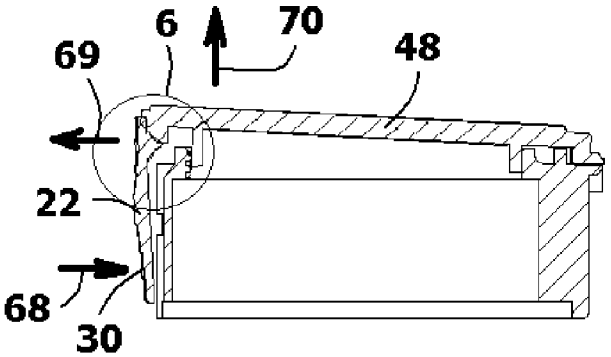
FIG. 5 is a cross-sectional view of the closure of FIG. 1 shown in a primed position.

In FIG. 4 and FIG. 5, the flip cap 48 is in its fully closed position. In the fully closed position, the nub 58 on the circular wall 56 is seated in the first groove 64 of the locking ring 62. This mechanical interconnection holds the flip cap 48 firmly closed.

Figure 6:
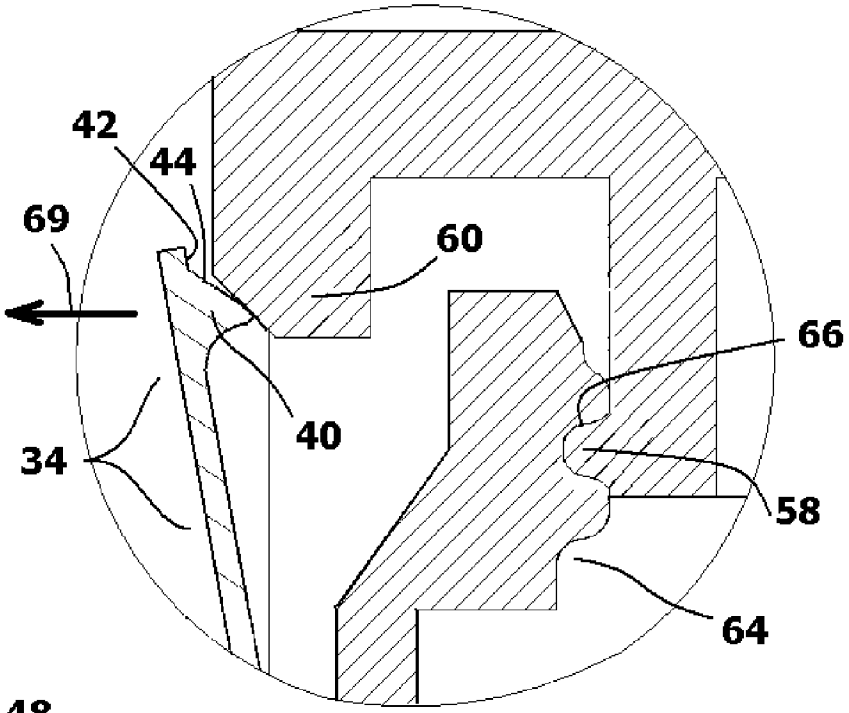
FIG. 6 is an enlarged view of the section of FIG. 5 shown in circled area 6.
Figure 7:
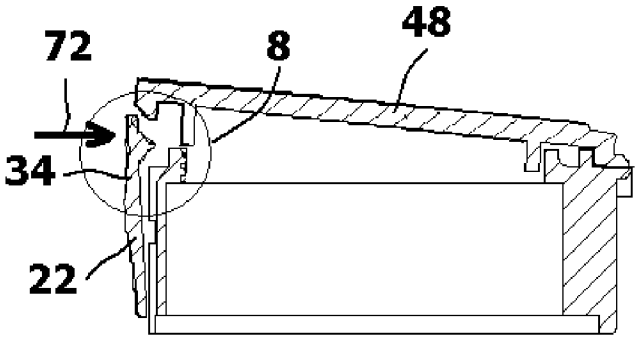
FIG. 7 is a cross-sectional view of the closure of FIG. 1 shown in an unlocked position.

Referring to FIG. 6 in conjunction with FIG. 7, the initial steps used to open the flip cap 48 from its fully closed position are explained. To open the flip cap 48, a user must first press the lower section 36 of the activation plate 22 in the direction of arrow 68. This causes the activation plate 22 to teeter so that the upper section 34 moves in the opposite direction of arrow 69. If a person accidentally attempts to press the upper section 34 of the activation plate 22 inwardly in opposition to arrow 69, no movement will occur. The flat section 42 above the protrusion 40 will merely press against the lifting wedge 60 with no resulting movement.

When the lower section 36 is pressed, the upper section 34 teeters and moves in the opposite direction. As the upper section 34 moves, the sloped section 44 of the protrusion 40 presses upwardly against the lifting wedge 60. This forces the flip cap 48 upwardly in the direction of arrow 70. The upward force causes the nub 58 on the circular wall 56 of the flip cap 48 to slip out of the first groove 64 and move into the higher second groove 66. This causes the flip cap 48 to lift very slightly and move from the fully closed position to the shown primed position. In the primed position, the flip cap 48 is still locked closed and there is still no access to the contents of the container through the closure assembly 10.

Figure 8:
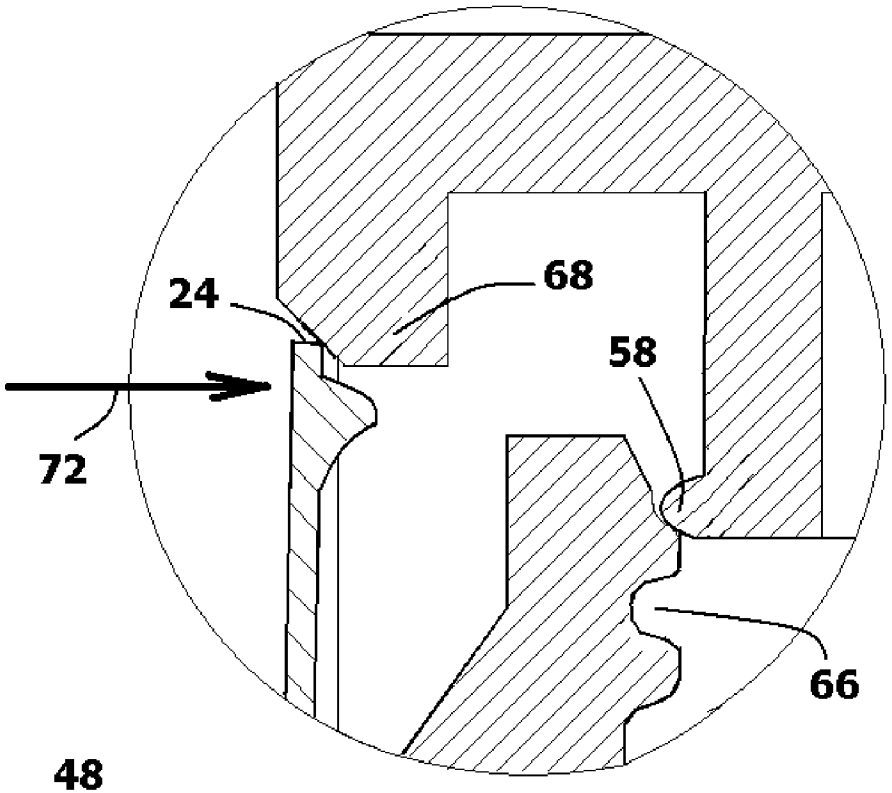
FIG. 8 is an enlarged view of the section of FIG. 7 shown in circled area 8.

Referring to FIG. 7 and FIG. 8, it can be seen that once the flip cap 48 is in the primed position, as is previously shown in FIG. 5 and FIG. 6, the flip cap 48 is ready to be fully opened. To fully open the flip cap, the upper section 34 of the activation plate 22 is depressed in the direction of arrow 72. This causes the top edge 24 of the activation plate 22 to move against the incline of the lifting wedge 60. This creates an upward force that moves the flip cap 48 upward. The action with the lifting wedge 60 causes the nub 58 to rise out of the second groove 66. This moves the flip cap 48 into its fully open position, as shown in FIG. 1 and FIG. 2.

Referring to all figures, it will therefore be understood that in order to open the flip cap 48 of the closure assembly 10, the activation plate 22 must be pressed in a distinct sequence. First, the lower section 36 of the activation plate 22 is depressed in order to move the flip cap 48 to its primed position. The upper section 34 of the activation plate 22 is then depressed to fully open the flip cap 48. The lower section 36 of the activation plate 22 must be pressed prior to the upper section 34 or else the flip cap 48 will not open. However, the lower section 36 and the upper section 34 of the activation plate 22 can be readily depressed using the one hand that is holding the container 11. As such, the closure assembly 10 can be opened using only one hand.

Figure 9:
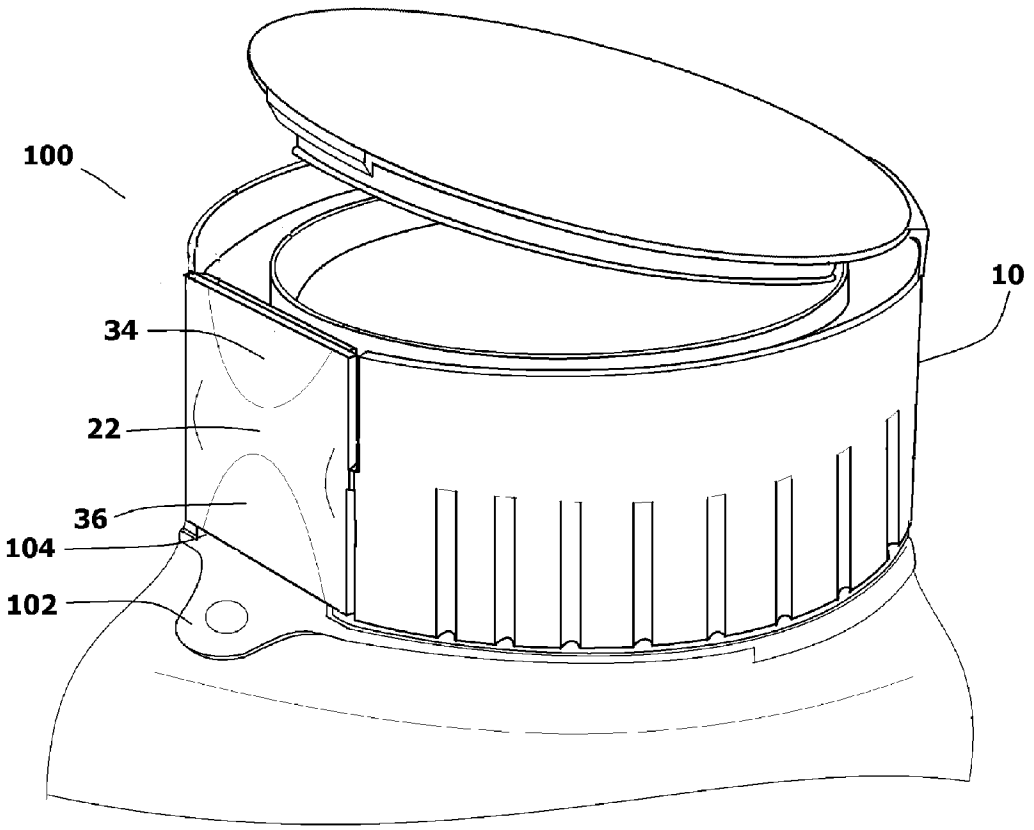
FIG. 9 is a perspective view of an alternate embodiment of a closure assembly.
Figure 10:
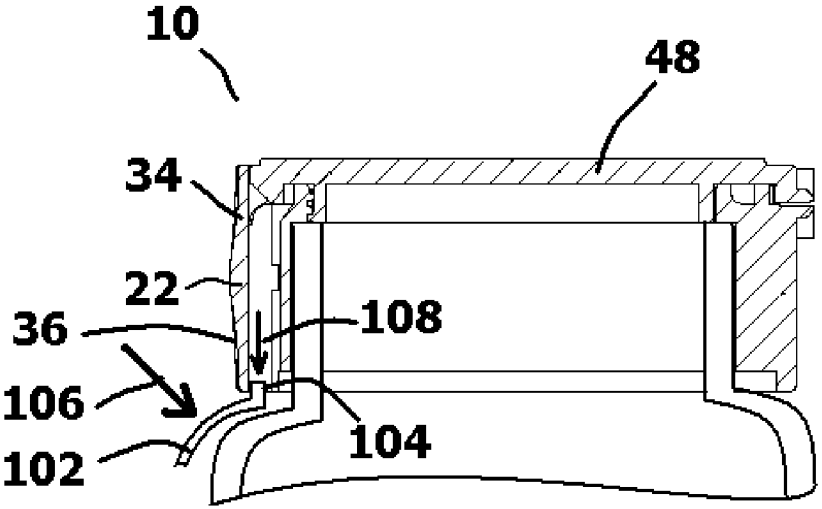
FIG. 10 is a cross-sectional view of the closure assembly shown in FIG. 9.

Referring to FIG. 9 in conjunction with FIG. 10, an alternate embodiment of an assembly 100 is shown. This embodiment has a closure assembly 10 that is identical in form and function to that previously described with reference to FIGS. 1-8. The description of the closure assembly 10 previously described is therefore incorporated herein and need not be repeated. Likewise, the previous reference numbers are used to identify same parts of the closure assembly 10. What differentiates the current assembly 100 from the earlier embodiment is the addition a tab 102 adjacent the activation plate 22. The tab 102 has a protrusion 104 that extends behind the lower section 36 of the activation plate 22. When the protrusion 104 is behind the activation plate 22, the lower section 36 of the activation plate 22 cannot be depressed. It will be understood from the earlier description that depressing the lower section 36 of the activation plate 22 is the first step in opening the closure assembly 10. As such, the presence of the protrusion 104 prevents the closure assembly 10 from being opened.

To displace the protrusion 104 from behind the activation plate 22, the tab 102 must first be depressed in the direction of arrow 106. This moved the tab downward and causes the protrusion 104 to move downwardly in the direction of arrow 108. Once the protrusion 104 is displaced below the activation plate 22, the lower section of the activation plate can be pressed in t\and the opening sequence continued.

The addition of the tab 102 adds complexity to the opening of the closure assembly 10. However, it still enables the closure assembly 10 to be opened with one hand. The opening of the closure assembly 10 no takes three sequences steps. In the first step, the tab 102 must be depressed. While the tab 102, the lower section 36 of the activator plate 22 is pressed. Lastly, the upper section of the 34 of the activator plate 22 is pressed to pop open the flip cap 48.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A child-resistant closure for a container, comprising:

an annular base that engages said container and defines an opening for accessing said container, wherein said annular base has a partial peripheral wall that extends from a first end to a second end, wherein a gap is defined between said first end and said second end;

a cap that is joined to said annular base at a hinged connection, wherein said cap can rotate about said hinged connection between a closed position, an open position and a primed position, wherein said cap covers said opening of said annular base in both said closed position and said primed position;

an activation plate mounted to said annular base within said gap with a teeter connection, said activation plate having an upper section and a lower section on opposite sides of said teeter connection;

a lock mechanism, controlled by said activation plate, that locks said cap over said opening, wherein said locking mechanism moves said cap from said closed position to said primed position when said lower section of said activation plate is depressed and said locking mechanism moves said cap from said primed position to said open position when said upper section of said activation plate is depressed, whereby said cap opens only after both said upper section and said lower section of said activation plate are separately pressed in a predetermined sequence.

2. The closure according to claim 1, wherein said annular base contains a first groove and a second groove proximate said gap, wherein said first groove and said second groove extend in parallel planes.

3. The closure according to claim 2, wherein said cap includes a nub that engages said first groove when said cap is in said closed position and engages said second groove when said cap is in said primed position.

4. The closure according to claim 3, wherein said lock mechanism includes a lifting wedge that extends from said cap, wherein said lifting wedge is contacted by said activation plate when said cap is in said closed position.

5. The closure according to claim 4, wherein said activation plate contacts said lifting wedge but does not displace said lifting wedge if said cap is in said closed position and said first section of said activation plate is depressed before said second section of said activation plate.

6. The closure according to claim 5, wherein said activation plate contacts said lifting wedge and displaces said cap to said primed position from said closed position when said first section of said activation plate is depressed.

7. The closure according to claim 5, wherein said activation plate contacts said lifting wedge and displaces said cap to said open position from said primed position when said second section of said activation plate is depressed.

8. The closure according to claim 4, further including a protrusion extending from said activation plate, wherein said protrusion contacts said lifting wedge on said cap when either said first section or said second section of said activation plate is depressed.

9. A child-resistant closure, comprising:

a base having a central opening extending therethrough, said base having a first groove and a second groove thereon at different elevations;

a cap that is joined to said base at a hinged connection, wherein said cap can rotate about said hinged connection between a closed position, a primed position and an open position, said cap having a nub thereon that engages said first groove, when in said closed position, engages said second groove when in said primed position, and is free of any groove when in said open position;

a mechanical activator coupled to said base with a teeter connection, said mechanical activator having a first section and a second section on opposite sides of said teeter connection that teeter about said teeter connection, wherein said mechanical activator displaces said cap to said primed position from said closed position when said second section of said mechanical activator is depressed; and wherein said mechanical activator displaces said cap to said open position from said primed position when said first section of said mechanical activator is depressed.

10. The closure according to claim 9, wherein said base has a partial peripheral wall that extends from a first end to a second end, wherein a gap is disposed along said peripheral wall between said first end and said second end.

11. The closure according to claim 10, wherein said mechanical activator is coupled to said base with said teeter connection within the gap.

12. The closure according to claim 10, further including a lifting wedge coupled to said cap, wherein said mechanical activator contacts said lifting wedge when either said first section or said second section of said mechanical activator are depressed.

13. A child-resistant closure, comprising:

a base that defines an access opening extending therethrough, said base having a first groove and a second groove thereon at different elevations;

a cap that is joined to said base at a hinged connection, wherein said cap can rotate about said hinged connection over said access opening between a closed position, a primed position and an open position, wherein said cap engages said first groove, when in said closed position, engages said second groove when in said primed position, and is free of both said first groove and said second groove when in said open position;

a mechanical activator coupled to said base, wherein said mechanical activator has a first section and a second section on opposite sides of a teeter connection, wherein said mechanical activator displaces said cap from said closed position to said primed position when said first section of said mechanical activator is depressed; and wherein said mechanical activator displaces said cap from said primed position to said open position when said second section of said mechanical activator is depressed, and a tab selectively positionable between a disengaged position and an engaged position, wherein said protrusion prevents said second section of said mechanical activator from moving about said teeter connection when in said engaged position.

14. The closure according to claim 13, wherein said base has a partial peripheral wall that extends from a first end to a second end, wherein a gap is disposed along said peripheral wall between said first end and said second end.

15. The closure according to claim 14, wherein said mechanical activator is coupled to said base within the gap.

16. The closure according to claim 13, wherein said cap obstructs said access opening when in both said closed position and said primed position.

* * * * *